US005495729A

United States Patent [19]

Sando et al.

[11] Patent Number: 5,495,729

[45] Date of Patent: Mar. 5, 1996

[54] METHOD FOR HIGH TEMPERATURE AND HIGH PRESSURE CONTINUOUS DYEING OF A CLOTH AND AN APPARATUS THEREFOR

[75] Inventors: Yoshiteru Sando; Hiroshi Ishidoshiro; Koji Sando, all of Wakayama, Japan

[73] Assignee: Sando Iron Works Co., Ltd., Wakayama, Japan

[21] Appl. No.: 335,477

[22] Filed: Nov. 7, 1994

[30] Foreign Application Priority Data

Nov. 8, 1993 [JP] Japan ..... 5-278481

[51] Int. Cl.[6] ..... D06B 3/12

[52] U.S. Cl. ..... 68/5 E; 68/9

[58] Field of Search ..... 8/149.1, 149.3, 8/931; 68/5 D, 5 E, 9

[56] References Cited

U.S. PATENT DOCUMENTS 2,905,522 9/1959 Fahringer ..... 68/5 E X 4,142,854 3/1979 Sando et al. ..... 8/149.1

*Primary Examiner*—Philip R. Coe

*Attorney, Agent, or Firm*—McAulay Fisher Nissen Goldberg & Kiel

[57] ABSTRACT

The object of the present invention is to make the addition of a dye solution to a long cloth passing through the interior of a high temperature and high pressure steamer continuously, smoothly and surely. Suitable amount of moisture is added to a cloth prior to the supply thereof to a high temperature and high pressure steamer, and a dye solution is added to the thus soaked cloth with the use of nozzles in the interior of the high pressure steamer body. The addition of the dye solution can be made on the entire surface of the cloth speedily and effectively in the interior of the high temperature and high pressure steamer.

1 Claim, 1 Drawing Sheet

METHOD FOR HIGH TEMPERATURE AND HIGH PRESSURE CONTINUOUS DYEING OF A CLOTH AND AN APPARATUS THEREFOR

BACKGROUND OF THE INVENTION

1. Field of the Invention

The present invention relates to a method and an apparatus for continuous dyeing of a cloth by using a high temperature and high pressure steamer.

2. Description of the Related Arts

As a dyeing method to dye a long cloth produced industrially in the treating and processing industry of a textile product, various methods have been developed. Particularly, a continuous dyeing method of a long cloth by using a high temperature and high pressure steamer has been developed by the present inventors.

The continuous dyeing method is to dye a long cloth continuously by using a high temperature and high pressure steamer comprising a steamer body in which a cloth inlet and a cloth outlet for passing a long cloth to be dyed continuously are provided, and a pair of seal mechanisms which are provided respectively at the cloth inlet and the cloth outlet and have a pair of pressure-contact seal rolls capable of maintaining high temperature and high pressure in the steamer body while allowing the passage of the cloth.

The dyeing method by using such a high temperature and high pressure steamer has such an excellent dyeing effect that an excellently dyed cloth can be obtained in a short time within several minutes by the wet heat above the ordinary pressure contained in the steamer body. However, in the case of such a dyeing process with the use of a high pressure steamer, when a cloth soaked with a dye solution out of the steamer body is supplied in the interior of the high temperature and high pressure steamer body, such a cloth soaked with a dyeing solution receives a pressure of the seal roll in passing through the roll, and consequently the dye solution contained in the cloth has squeezed out due to the pressure of the roll. Thus, the steaming of a cloth containing sufficient dyeing solution can not be done, and there occurs the difficulty that a dense color dyeing and an excellent dyeing can difficulty be done.

SUMMARY OF THE INVENTION

The present invention is made in paying attention to these problems. Namely, in the method for continuous dyeing with the application of wet heat in the interior of a high temperature and high pressure steamer, a dye solution jetted from a dye solution jetting nozzle is given to the cloth in the interior of the high temperature and high pressure steamer. Moisture has been given to the cloth previously at the outside of the high temperature and high pressure steamer for elevating the permeability of the dye solution given to the cloth with the use of the dye solution jetting nozzle to the cloth. In this way, in the present invention, to the entire surface of the cloth supplied continuously in the interior of the high temperature and high pressure steamer, a definite amount of the dye solution effective for the dyeing is given speedily and uniformly so as to obtain a dyed cloth with excellent quality.

BRIEF DESCRIPTION OF THE DRAWINGS

EXAMPLE

Figure 1:
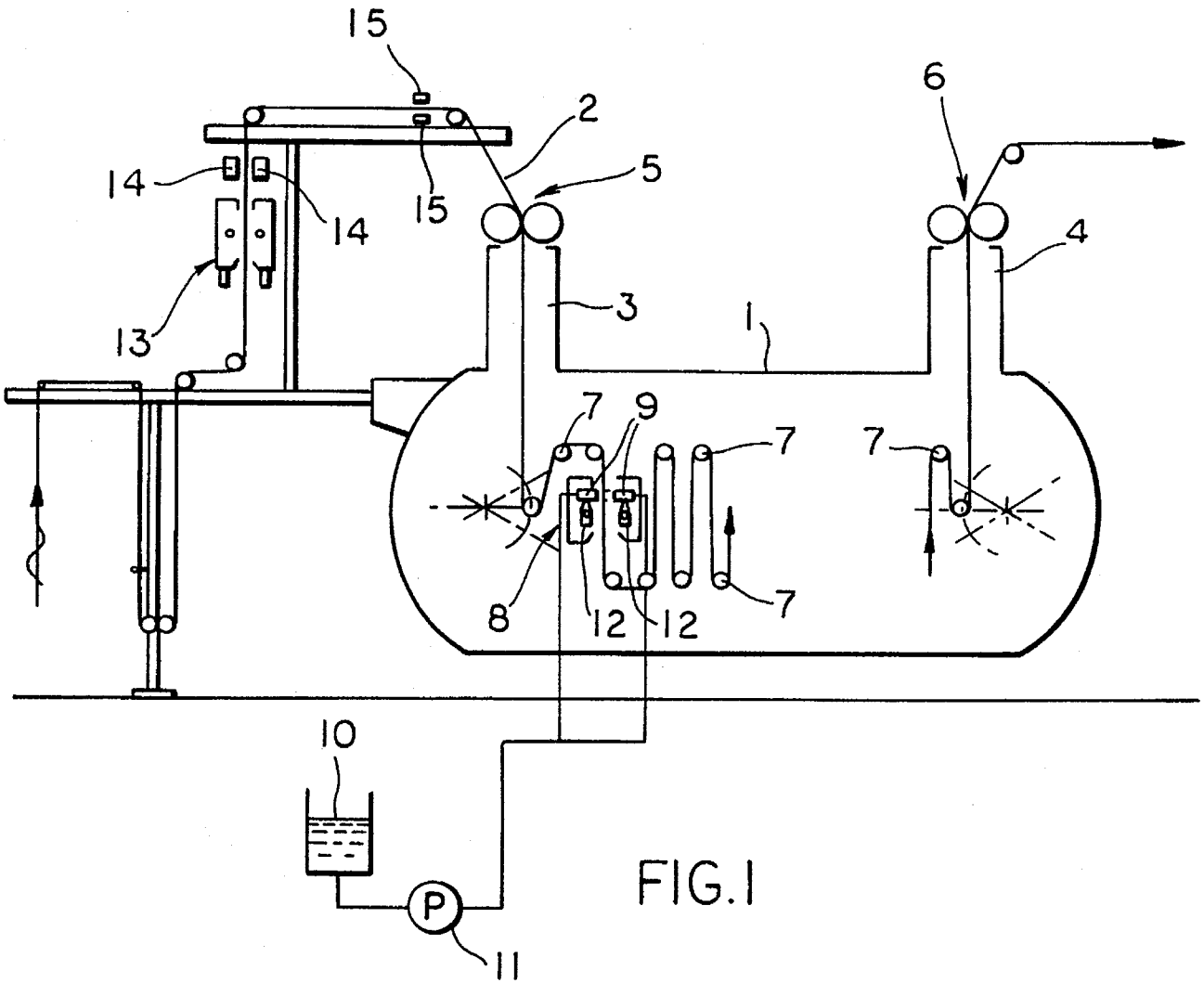

FIG. 1 is an explanatory drawing showing the structure of the continuous dyeing apparatus according to an example of the present invention.

The present invention will be explained in detail based on the example of the present invention shown in the drawings.

In the figure, 1 is a steamer body for subjecting a long cloth 2 to be dyed by a dyeing treatment continuously under high pressure wet heat. In this steamer body 1, an inlet of the cloth 3 and an outlet of the cloth 4 are provided for passing the cloth 2 continuously, and further a sealing mechanism 5 at the inlet side and a sealing mechanism 6 at the outlet side, which have respectively a pair of seal rolls for sealing the inlet side 3 and the outlet side 4 are provided in the steamer body 1. 7 are the guide rolls provided in the interior of the steamer body 1, and the timing of the wet heat reaction of the cloth supplied in the steamer body 1 is maintained by passing in the state of up and down undulations.

8 is a mechanism for supplying the dye solution so as to give the dye solution to both sides of the cloth supplied in the steamer body 1. An appropriate amount of the dye solution is given from its storage tank 10 with the use of a pump 11 for jetting a suitable amount of the dye solution. The mechanism for supplying the dye solution 8 is comprising a pair of nozzles for jetting the dye solution 9, each of which has a plurality of nozzle holes in the width direction of the cloth together with the mechanisms for shaking 12 for uniforming the dye solution applied on the surface of the cloth by the reciprocating movement of the nozzles for jetting 9 corresponding to the amount of the pitch of each nozzle holes in the width direction of the cloth.

13 is a moisture supplying box for supplying moisture to the cloth prior to be supplied to the interior of the steamer body 1, and both sides of the cloth passing through the moisture supplying box 13 are moistened uniformly for instance by means of a spray.

14 is a sensor for determining the moisture content of the cloth passed through the above mentioned moisture supplying box 13, and it is possible to control the amount of water supplied in the moisture supplying box 13 based on the output signal from the sensor for determining the moisture content 14.

15 is a sensor for detecting the width of the cloth 2 immediately before the cloth is supplied into the steamer body 1, and the scanning width of the previously mentioned dye solution jetting nozzle 9 is controlled due to the output of the above mentioned sensor for determining the width of the cloth 15 so as to adhere the dye solution to all the surface of the cloth widths efficiently.

While the above-mentioned is an example of the apparatus with which the present invention can be executed, its action will be stated in the following.

By maintaining the interior of the steamer body 1 to a desired high temperature and high pressure wet heat condition, the cloth to be dyed 2 is passed through the interior of the steamer body, but the cloth 2 prior to be sent into the steamer body has been wetted all-over its total area by passing though the interior of the moisture supplying box 13. The wetted amount has been controlled thereby to the prescribed value by means of the sensor for determining the moisture content 14.

The cloth 2 thus established to the moisture content 2 is passed through the sensor for determining the width of the cloth 15 for measuring the width of the cloth and is supplied into the interior of the steamer body 1.

The cloth 2 thus supplied into the steamer body 1 is passed through the interior of the mechanism for supplying the dye solution 8, and all the widths of the cloth is wetted by receiving the dye solution jetted from the dye solution jetting nozzles 9 thereby.

Since the cloth to receive the dye solution jetted from the dye solution jetting nozzles 9 has previously been heated to an appropriate temperature by means of the moisture supplying box 13, the permeation of the dyeing solution thereto jetted from the dye solution jetting nozzles is speedy and excellent, and thus the absorption of the dye solution on the cloth surface can be done smoothly. Further, the amount of moisture supplied of the cloth by means of the moisture supplying box 13 is determined by means of the sensor for determining the moisture content 14, and the moisture content can be controlled so as always constant in accordance with the quality of the cloth 2 to be treated. Further, in connection with the amount of moisture to be added, it is economical to add necessary and sufficient amount of the dye solution to the running cloth 2 by setting the amount of the dye solution jetted from the dye solution jetting nozzle 9, and thereby a dyed cloth with high quality can continuously by produced.

Further, since there are many kinds of cloth-width in the cloth to be dyed, when the cloth-width is detected by means of the cloth-width sensor 15 and the jetted-width from the dye solution jetting nozzle 9 is controlled for instance with the use of a valve (not shown in the figure) in accordance with the cloth-width, the jetting-width of the dye solution can be controlled in accordance with the cloth-width, and thus the use of excess dye solution can be dissolved, and further all the surface of the cloth can be dyed uniformly.

By the way, since the cloth is wetted before it is supplied into the steamer body and the resultant wetted cloth is contacted under pressure to the seal roll (made of rubber) of the steamer body 1, the present inventive process has also a feature that the adhesion of the cloth to the seal roll due to the surface heat of the seal roll can previously be prevented.

As above described, the present invention is to add a suitable amount of moisture to a cloth prior to be supplied in a high pressure steamer, and to supply a dye solution jetted from a nozzle to the moistened cloth in the interior of the high pressure steamer. Therefore, the permeability of the dye solution to the cloth in the high pressure steamer is excellent, and thus it is possible that the excellent dyeing all-over the cloth can be done. Further, since the cloth passing through the inlet side seal mechanism of the steamer has already been moistened, there is an effect that the inconvenience of causing the adhesion of the cloth to the seal mechanism due to scorching can previously be prevented.

What is claimed is:

1. An apparatus for high temperature and high pressure continuous dyeing comprising a transport path for a long cloth to be dyed, a moisture supplying box for wetting the long cloth, a moisture rate determining sensor arranged in succession to the moisture supplying box, a cloth-width detecting sensor arranged in succession to the moisture rate determining sensor, a high pressure steamer arranged next to the cloth-width detecting sensor, a nozzle for supplying a dye solution to the wetted cloth in the steamer, and a controlling mechanism for controlling the width of the dye solution jetted from the nozzle corresponding to the width of the cloth on the basis of an output from the cloth-width detecting sensor.

* * * * *